United States Patent [19]

Smith

[11] 4,177,950

[45] Dec. 11, 1979

[54] CONTROL FOR A POWER PLANT COAL MILL PULVERIZER HAVING FEEDFORWARD DAMPER POSITIONING

[75] Inventor: William J. Smith, Verona, Pa.

[73] Assignee: Westinghouse Electric Corp., Pittsburgh, Pa.

[21] Appl. No.: 878,614

[22] Filed: Feb. 16, 1978

[51] Int. Cl.[2] ..... B02C 25/00

[52] U.S. Cl. ..... 241/33; 241/34

[58] Field of Search ..... 241/33, 34

[56] References Cited

U.S. PATENT DOCUMENTS

| | | | |
|---|---|---|---|
| 2,003,985 | 6/1935 | Wallene | 241/34 X |
| 2,060,375 | 11/1936 | Ishimura | 241/34 |
| 2,152,367 | 3/1939 | Smith | 241/34 |
| 2,226,923 | 12/1940 | Cross | 241/34 X |
| 2,419,436 | 4/1947 | Boho | 241/34 |
| 2,894,696 | 7/1959 | Miller | 241/34 X |

*Primary Examiner*—Robert L. Spicer, Jr.
*Attorney, Agent, or Firm*—E. F. Possessky

[57] ABSTRACT

Power plant boiler fuel demand is transmitted as a coal feeder speed demand to a coal pulverizer control. A speed controller operates the feeder in accordance with the speed demand, and a position controller for a hot coal transport air damper positions the hot air damper to hold the mill outlet temperature to a setpoint value and to increase or decrease damper position in accordance with a feedforward signal representing the feeding speed demand. A position controller for a cold air damper regulates the total primary air flow to a value needed for safe and smooth transport of the pulverized coal to the boiler burners, and it accordingly acts as a process trim on the feedforward control applied by the hot damper controller.

4 Claims, 5 Drawing Figures

CONTROL FOR A POWER PLANT COAL MILL PULVERIZER HAVING FEEDFORWARD DAMPER POSITIONING

BACKGROUND OF THE INVENTION

The present invention relates to electric power plants and more particularly to control systems employed with coal pulverizers in such plants.

In the operation of a coal fired electric power plant, coal is fed to a pulverizer mill where it is finely ground for mixture with the primary air flow and transported to the burners. In many cases, the inlet hot and cold air flow mix is varied by damper positioning to hold a desired mill exit temperature for the primary air and coal mixture. Further, the total primary air flow is typically regulated to a setpoint value by damper positioning. In one particular prior art arrangement, the hot and cold air dampers are moved in the same direction for flow corrections and they are moved in opposite direction for outlet temperature corrections.

When a feeder speed change occurs in response to a change in fuel demand from the boiler control, the rate at which coal is fed to the pulverizer changes. Then, as the amount of pulverized coal produced for transport by the primary air begins to change, the pressure drop across the mill changes causing the air flow and the exit temperature to change. For example, with a feeder speed increase the amount of pulverized coal begins to increase causing greater pressure drop and reduced primary air flow and reduced outlet temperature. The pulverizer control operates the dampers to make needed flow corrections during the process transient condition.

In the known prior art, pulverizer control configurations have not been as effective as desirable because the response time needed for achieving primary air flow correction has been excessive. Thus, the time for flow correction is so great in many existing installations that undesirable disturbances occur in the boiler outlet steam pressure when fuel changes are required. The primary reason for this is that pulverizer controls typically employ feedback control loops which provide correction only after process errors begin to occur. Thus, the time required for a change in feeder speed to be effected through the pulverizer process significantly affects the response time of prior art pulverizer controls. While feedforward control may generally avoid process error and improve process response, there is no known prior art which discloses how feedforward control can be successfully employed in achieving improved pulverizer control response time without disturbing the smooth and continuous flow of coal to the burners, i.e., without causing settlement of fines and without causing oversize coal to be held in suspension above the pulverizing mechanism.

SUMMARY OF THE INVENTION

A control is provided for an electric power plant pulverizer mill which has a variable speed feeder and hot and cold air ducts supplying primary air flow through the pulverizer under the control of respective hot and cold air dampers. The control comprises means for sensing the temperature of the mill outlet flow, means for sensing the primary air flow, means for generating a feeder speed demand and means for operating the feeder in accordance with the feeder speed demand. The hot damper is positioned in accordance with a hot damper position demand and the cold damper is positioned in accordance with a cold damper position demand. The damper position demands are generated in response to the flow and temperature sensing means to control total primary air flow in accordance with a predetermined function and to control the mill outlet temperature in accordance with another predetermined function. The feeder speed demand is applied to the damper position demand generating means to produce anticipatory movement of at least one of the dampers in response to feeder speed demand changes.

DESCRIPTION OF THE PREFERRED EMBODIMENT

Figure 1:
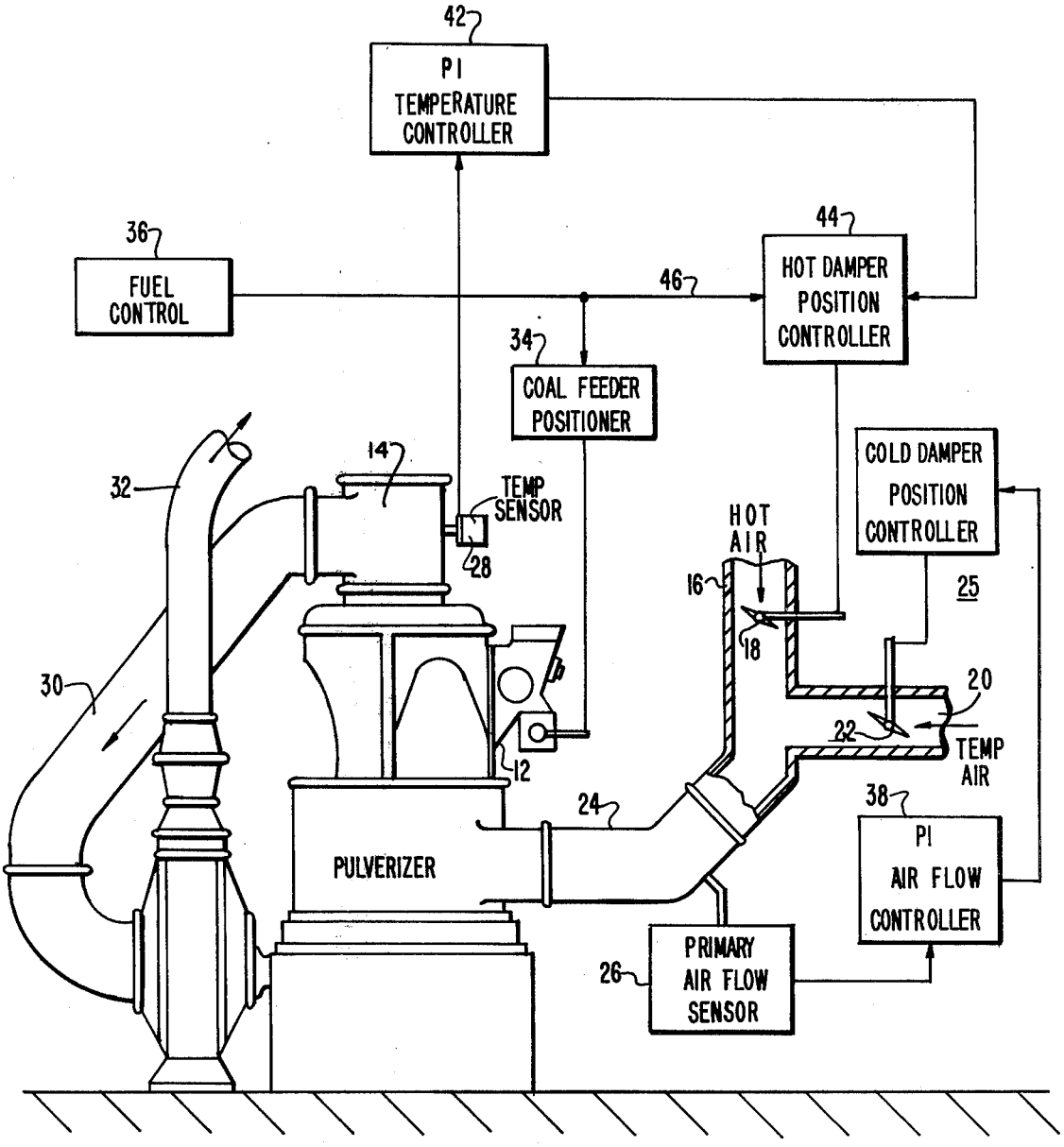
FIG. 1 shows a schematic view of a coal pulverizer mill and the manner in which it is controlled in accordance with the principles of the invention.

More particularly, in FIG. 1 there is shown a conventional coal mill pulverizer 10 having a belt or other conventional feeder 12 which receives coal from bunkers (not shown). Generally, the coal is pulverized by rollers (not shown) so that nominally at least 80% of the ground coal would pass through a 200 mesh screen. A classifier section 14 returns the oversize coal particles back to the pulverizing section for recycling.

A minimum primary air flow is required to prevent unsafe settlement of the fine coal in the transport line into separate fuel slugs which could cause explosive activity at the burners. To provide for smooth and safe boiler operation the primary air flow is specified in this embodiment to be a constant value which is sufficient to transport the pulverized coal and which is well above the minimum safe value. However, the primary air flow setpoint value is not so great as to have that force which would cause oversize coal particles to be carried upward from the rollers and thus inhibiting grinding and creating a recycling load within the pulverizer. Although, the primary air flow is controlled to a setpoint value in this embodiment, such flow could be variable as the pulverizer is controlled to satisfy boiler demands in other applications of the invention.

Hot air is obtained from a preheater (not shown) through a duct 16 under the control of a variably positioned damper 18. Cold air is supplied through a duct 20 under the control of a variably positioned damper 22. The mixed inlet air passes through a primary air duct 24 where a flow sensor 25 is located.

In the pulverizer 10, the primary air passes through the grinding section and carries pulverized coal through the classifier 14 to the mill exit where a temperature sensor 28 is located. The pulverized coal is then transported to the burners through ducts 30 and 32.

A pulverizer control 25 includes a conventional coal feeder positioner 34 which controls the feeder speed in response to speed demand from a suitable fuel controller 36. Similarly, a flow controller 38 operates a positioning control 40 for the cold air damper 22. A control 44 for the hot air damper operates in response to the output of a pulverizer temperature controller 42 and in response to a feedforward application of the feeder speed demand as indicated by the reference character 46.

The transient response of the pulverizer process to feeder speed changes is significantly and safely shortened by operation of the described control system. Thus, the control in effect anticipates the way in which the process would normally deviate when a feeder speed change occurs and action is taken immediately to reduce the process deviation. Such improvement is realized in the pulverizer 10 as well as other known pulverizers having different structural designs from that shown for the pulverizer 10.

Figure 2:
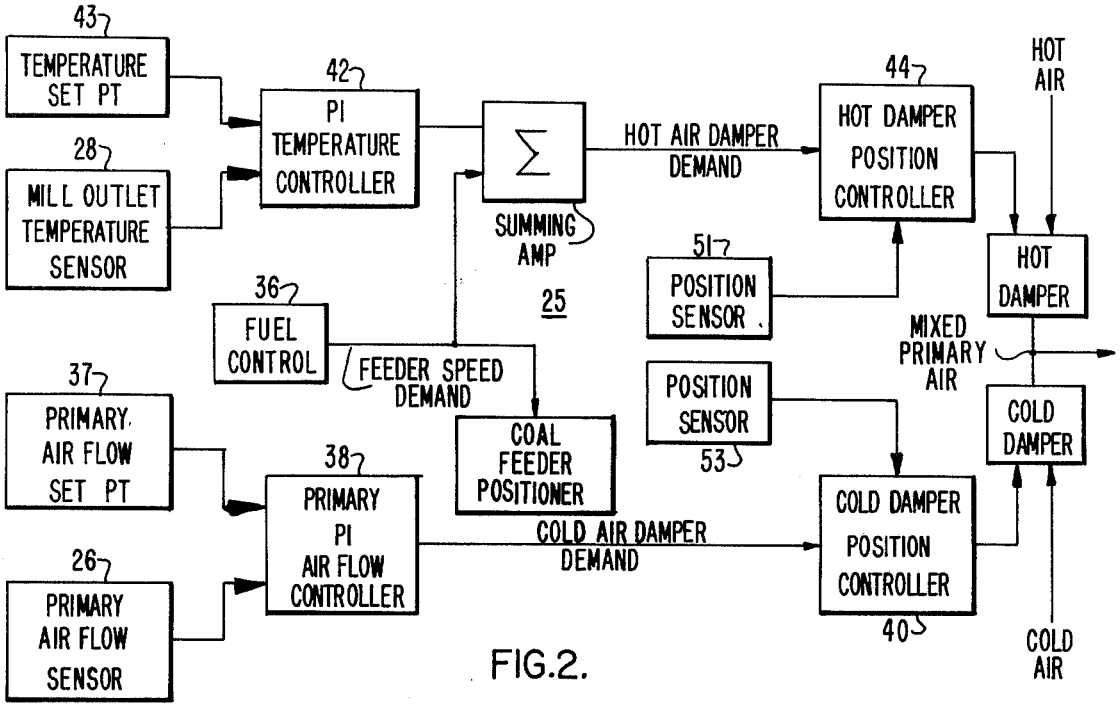
FIG. 2 shows a block diagram of the pulverizer control of FIG. 1 in greater detail.

Portions of the pulverizer control 25 are separately shown in greater detail in FIG. 2. The temperature controller 42 is preferably a conventional proportional plus integral (PI) controller which responds to a temperature setpoint 43 and the temperature sensor 28 to drive the hot air damper position control to zero mill outlet temperature error. A summer 45 combines the temperature controller signal and the feedforward feeder speed demand signal from the fuel control 36 to apply a single position demand signal to the hot air damper position control 44.

A PI controller is also preferably used for the flow controller 38. As shown, the flow controller 38 responds to a primary air flow setpoint 37 and the flow sensor 26 in developing a control signal which is applied as a cold air damper position demand to the cold air damper position control 40. Position sensors 51 and 53 are used by the respective damper position controls 44 and 40 in meeting damper position demands.

In operation, an increase in feeder speed demand needed to avoid a drop in boiler outlet steam pressure simultaneously causes (1) the feeder to increase its fuel feed rate and (2) the hot air damper position control to open the damper to a position needed to maintain the primary air flow and mill outlet temperature in anticipation of the the effects of the increase in the fuel feed rate.

If the hot air damper position is still somewhat in error as the process change is transported to the mill outlet, the temperature controller 42 and the flow controller 38 jointly operate as a trim on the feedforward control action. Any transported outlet temperature error results in some minor repositioning of the hot air damper through the controls 42 and 44. Any transported primary air flow error results in some minor cutback positioning of the cold air damper through the controls 38 and 40.

Normally, feedback trim control action is not significant and the overall control response time is significantly reduced while providing smooth and stable operation of the pulverizer 10 by operation of the invention. Decreases in feeder speed demand result in process control action which is opposite to that described for feeder speed increases.

Figure 4:
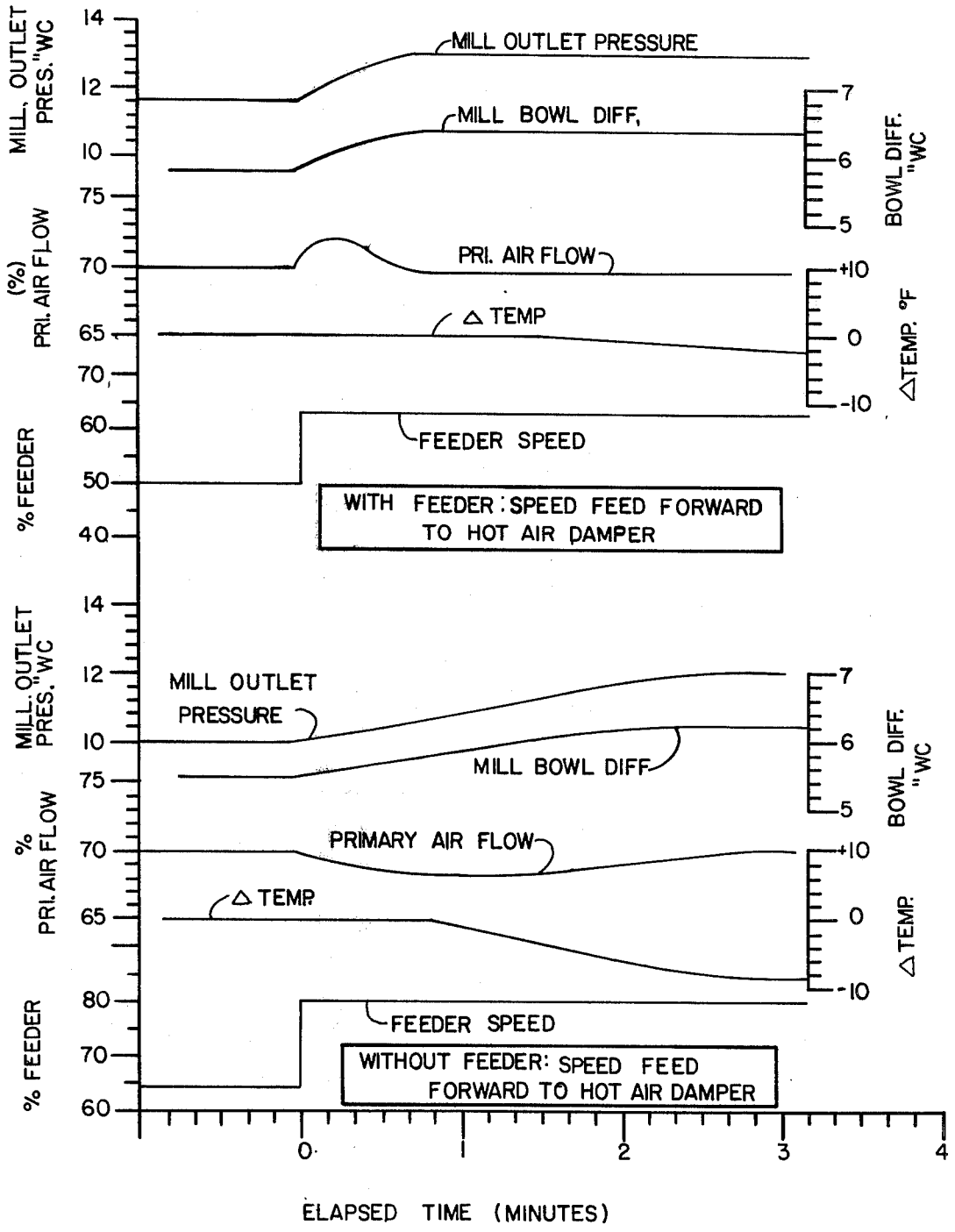
FIG. 4 shows mill responses to a step feeder increase both with the employment of feedforward control in accordance with the invention and without such feedforward control in accordance with the typical prior art.
Figure 5:
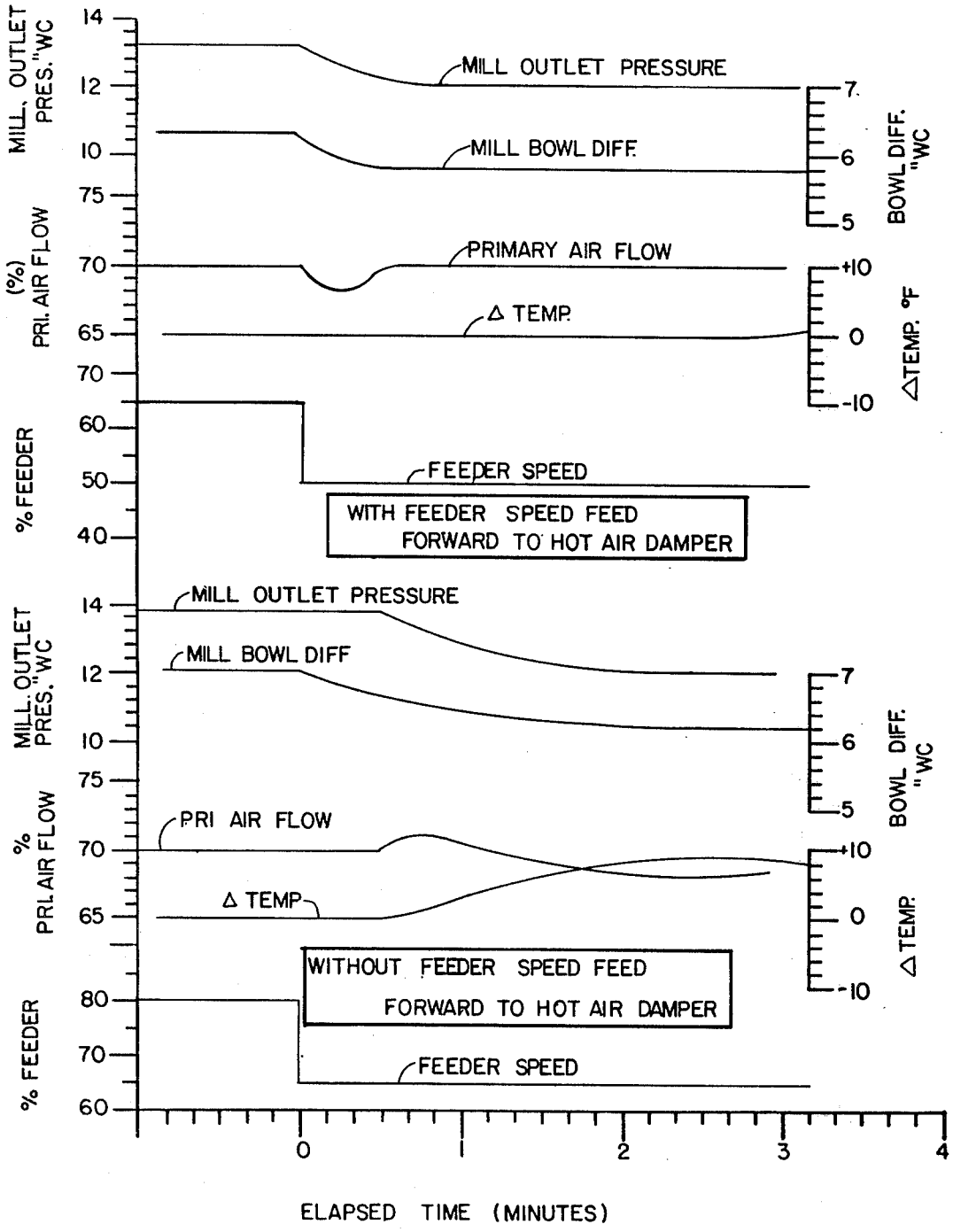
FIG. 5 is like FIG. 4 but it shows responses to a step feeder speed decrease.

As shown in FIGS. 4 and 5, actual mill tests demonstrate the improvement realized in time response. With a feeder speed increase at time=0 in FIG. 4, the prior art mill responds with a disturbance for nearly three minutes in primary air flow, a drop of nearly 10° F. in the mill outlet temperature over a three-minute time period (with correction occurring later), and a period of nearly three minutes before mill outlet pressure and mill bowl differential settle out at higher values. Thus, the transient conditions clearly persist for nearly three minutes in the pulverizer.

In the pulverizer mill 10, the primary air flow disturbance occurs for about 45 seconds, an outlet temperature drop is limited to about 2° F. over a three-minute time period, and mill outlet pressure and mill bowl differential settle out in less than one minute. Use of the invention thus clearly provides an improvement in system response.

Figure 3:
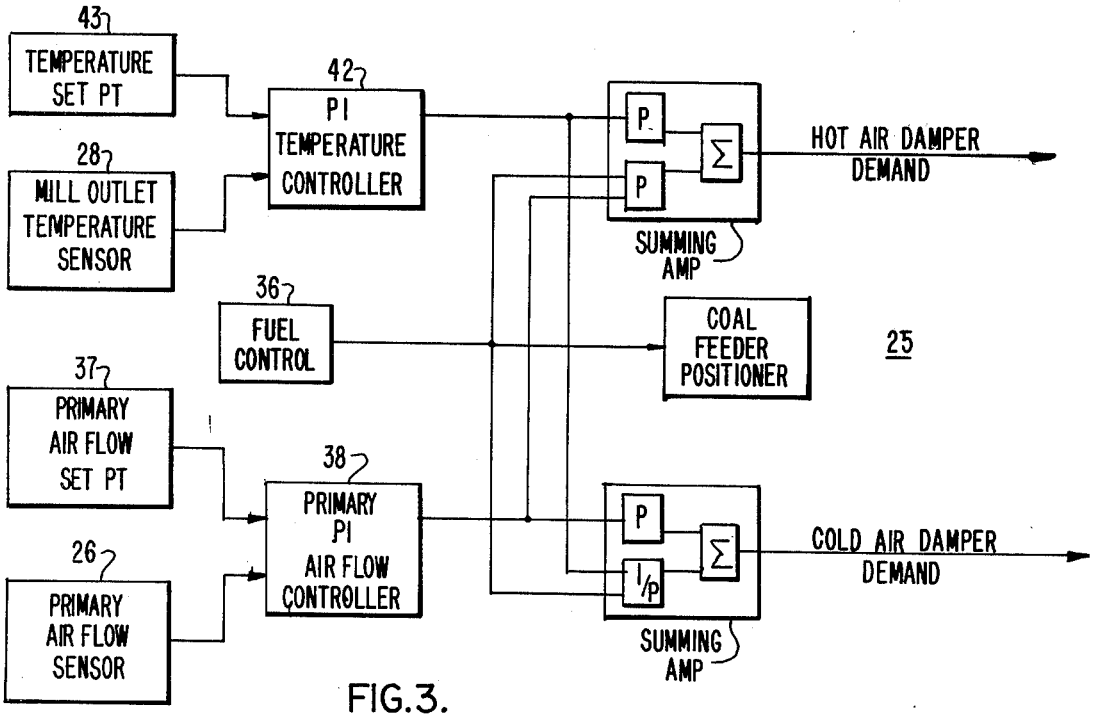
FIG. 3 shows a block diagram of a modified pulverizer control in accordance with another embodiment of the invention.

In FIG. 3, there is shown an alternative embodiment of the invention. In this case the feedforward feeder speed demand is applied to provide opposite movements of the hot and cold dampers on feeder speed changes. For example, the hot damper is further opened and the cold damper is further closed on feeder speed increases. This embodiment provides a slower process response to feeder speed changes than does the preferred embodiment, but the speed of response is still faster than that of the prior art.

What is claimed is:

1. A control for an electric power plant pulverizer mill having a variable speed feeder and hot and cold air ducts supplying primary air flow through said pulverizer under the control of respective hot and cold air dampers, said control comprising means for sensing the temperature of the mill outlet flow, means for sensing the primary air flow, means for generating a feeder speed demand, means for operating the feeder in accordance with the feeder speed demand, means for positioning the hot damper in accordance with a hot damper position demand, means for positioning the cold damper in accordance with a cold damper position demand, means for generating the damper position demands in response to said flow and temperature sensing means to control total primary air flow in accordance with a predetermined function and to control the mill outlet temperature in accordance with another predetermined function, and means for applying the feeder speed demand to said damper position demand generating means to produce anticipatory movement of at least one of the dampers in response to feeder speed demand changes.

2. A control as set forth in claim 1 wherein the total primary air flow and the mill outlet temperature are controlled to respective setpoint values and wherein said damper position demand generating means applies a position demand to said hot damper positioning means on the basis of feeder speed demand and further applies a position demand to said cold damper positioning means on the basis of the flow setpoint and an output from said flow sensor.

3. A control as set forth in claim 2 wherein means are provided for generating a mill outlet temperature setpoint, controller means are provided for generating a temperature correction based on the actual and setpoint temperatures, and said damper position demand generating means generates the hot damper position demand as a function of the feeder speed demand and the temperature correction.

4. A control as set forth in claim 1 wherein the total primary air flow and the mill outlet temperature are controlled to respective setpoint values and wherein said damper position demand generating means applies a position demand based on feeder speed demand to said hot damper positioning means and said cold damper positioning means to move the dampers in opposite directions on changes in feed speed demand.

* * * * *